US007219371B2

(12) United States Patent
Liu

(10) Patent No.: US 7,219,371 B2
(45) Date of Patent: May 22, 2007

(54) SAFETY HELMET FOR HEAT DISSIPATION

(75) Inventor: Ying Liu, Shenzhen (CN)

(73) Assignee: Multi Polar Enterprises (Shen Zhen) Limited, Shenzhen (CN)

( * ) Notice: Subject to any disclaimer, the term of this patent is extended or adjusted under 35 U.S.C. 154(b) by 189 days.

(21) Appl. No.: 10/513,017

(22) PCT Filed: May 30, 2003

(86) PCT No.: PCT/CN03/00414

§ 371 (c)(1),
(2), (4) Date: Oct. 28, 2004

(87) PCT Pub. No.: WO03/101232

PCT Pub. Date: Dec. 11, 2003

(65) Prior Publication Data

US 2005/0177918 A1 Aug. 18, 2005

(30) Foreign Application Priority Data

Jun. 2, 2002 (CN) ..... 02 2 36885

(51) Int. Cl.
*A42B 1/00* (2006.01)

(52) U.S. Cl. ..... 2/7; 2/209.5

(58) Field of Classification Search ..... 2/410, 2/171.3, 209.3, 209.5, 209.7, 175.8, DIG. 1, 2/7

See application file for complete search history.

(56) References Cited

U.S. PATENT DOCUMENTS

| | | | | |
|---|---|---|---|---|
| 554,600 | A * | 2/1896 | Hirschberg | 2/209.4 |
| 690,230 | A * | 12/1901 | Caldwell | 2/209.3 |
| 2,004,913 | A * | 6/1935 | Klein | 2/209.5 |
| 2,398,561 | A * | 4/1946 | Ruggiero | 2/410 |
| 2,699,553 | A * | 1/1955 | Byers et al. | 40/329 |
| 3,030,632 | A * | 4/1962 | Shelton | 2/209.3 |
| 4,114,201 | A * | 9/1978 | Garrison | 2/209.7 |

FOREIGN PATENT DOCUMENTS

| | | |
|---|---|---|
| CN | 1061518 | 6/1992 |
| CN | 1313061 | 9/2001 |
| WO | WO 00/18262 | 4/2000 |

* cited by examiner

*Primary Examiner*—Rodney Lindsey
(74) *Attorney, Agent, or Firm*—Jenkens & Gilchrist, P.C.

(57) ABSTRACT

The present invention relates to a heat dissipating safety helmet comprising a shell, a liner and a strap. The shell comprises a top portion, a rim, and a visor outwardly extending from the rim, a plurality of spaced longitudinal strips connecting the top portion and the rim. The top portion, longitudinal strip and visor are integrally molded. There are transverse strips between the longitudinal strips, which are transversely interlaced with longitudinal strip. The helmet is weatherable, safe, air-permeable, heat dissipating, durable.

6 Claims, 1 Drawing Sheet

SAFETY HELMET FOR HEAT DISSIPATION

This application claims priority to World patent application PCT/CN03/00414 filed May 30, 2003 which claims priority to Chinese patent application CN 02236885.X filed Jun. 2, 2002.

FIELD OF THE INVENTION

The invention relates to a safety helmet. More particularly, the invention relates to a heat dissipating safety helmet.

BACKGROUND OF THE INVENTION

A woven safety helmet now on the market are woven from a variety of substances such as bamboo, rattan or osier. These helmets have inadequate weatherability and protection. They are fragile, flammable, easily broken, and not durable thus they are gradually replaced by molded safety helmets. The molded safety helmets provide good protection but the main disadvantage is air impermeable. Wearers feel uncomfortable because heat cannot be dissipated through the helmet effectively. When the weather is hot, they do not like to wear them and as a result work safety is affected. The benefit of the woven safety helmets is air-permeability so many people still use them. For the above reasons, there have been a research on a woven heat dissipating safety helmet made of a new substance and by a new process, improving the helmet in weatherability, heat insulation, stiffness, heat dissipation, protection, durability, air-permeability so that the helmet enhances safety of human being.

SUMMARY OF THE INVENTION

The object of the invention is to provide a safety helmet comprising a shell, a liner and a strap. The shell comprises a top portion, a rim and a visor outwardly extending from the rim, a plurality of spaced longitudinal strips connecting the top portion and the rim. The top portion, longitudinal strips and visor are integrally molded. There are transverse strips between the longitudinal strips, which are transversely interlaced with the longitudinal strips.

The object of the invention is to provide a heat dissipating safety helmet wherein the transverse strips are hollow and may contain threads or a bundle of wires therein. The transverse strips are attached together by fusing, adhesive bonding or supersonic bonding. The transverse strips also possess an antislipping or waterproof structure.

The object of the invention is to provide a heat dissipating safety helmet wherein the shell is made of plastic or composite material. The plastic and composite material possess properties selected from anti-electrostatic property, nonflammable property, heat insulating property, heat reflecting property, heat preserving property, weatherable property, coloured property and germicidal property.

The object of the invention is to provide a heat dissipating safety helmet wherein the helmet comprises a mounting structure for at least one device selected from goggles, lamp, earplug, mask, breathing device and water shield. The helmet is made of a heat insulating or shock-absorbing material. It also comprises electronic alarm or fluorescent device.

DETAILED DESCRIPTION OF THE DRAWINGS

Figure 1:
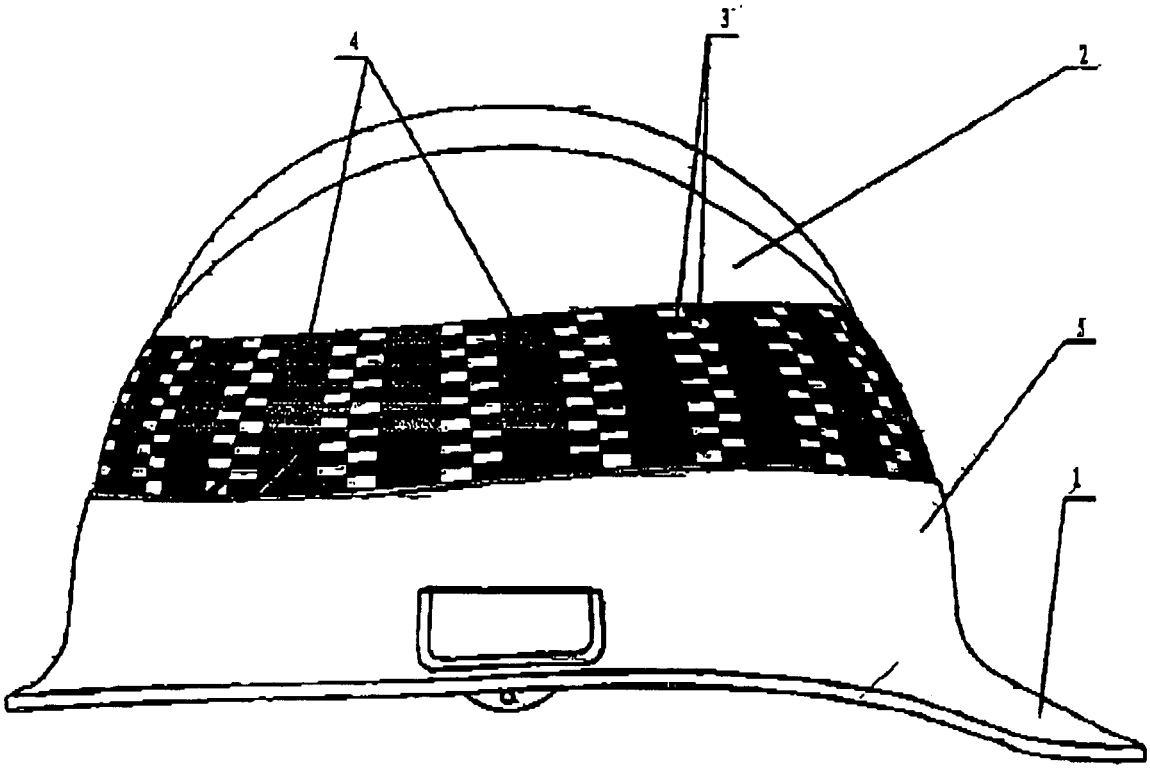
FIG. 1 shows the safety helmet according to the present invention.

As shown in FIG. 1, the heat dissipating safety helmet comprises a shell, a liner and a strap. The shell comprises a top portion 2, a rim 5 and a visor 1 outwardly extending from the rim 5, a plurality of spaced longitudinal strips 4 connecting the top portion 2 and rim. The top portion 2, longitudinal strips 4 and visor 1 are integrally molded. There are transverse strips 3 between the longitudinal strips, which are transversely interlaced with the longitudinal strips 4.

The transverse strips of the heat dissipating safety helmet are made hollow so that it contains threads or a bundle of wires therein.

The shell of the heat dissipating safety helmet is made of plastic or composite material The plastic or composite material may possess enhanced properties selected from anti-electrostatic property, nonflammable property, heat insulating property, heat reflecting, property, heat preserving property, weatherable property, coloured property, germicidal property.

In the heat dissipating safety helmet, the heat insulating material or shock absorbing material is formed by spraying, electroplating, adhering or fixing.

In the present heat dissipating safety helmet, the transverse strips are interlaced with the longitudinal strip by merging, adhesive bonding or supersonic bonding.

In the present heat dissipating safety helmet, one transverse strip is used in weaving. Alternatively, a plurality of transverse strips may be used.

The present heat dissipating safety helmet comprises a electronic alarm or flurorescent device.

The present heat dissipating safety helmet comprises a mounting structure for goggles, mask, lamp, earplug, breathing device, water shield.

The present heat dissipating safety helmet comprises a support structure for the liner and the strap at the rim.

The present heat dissipating safety helmet wherein the transverse strips have an antislipping or waterproof structure.

The invention claimed is:

1. A heat dissipating safety helmet comprising:

a shell, wherein the shell comprises a top portion (2), a rim (5) and a visor (1) outwardly extending from the rim (5);

a plurality of spaced longitudinal strips (4) connecting the top portion (2) and rim (5); and wherein the rim (5), the top portion (2), longitudinal strips (4) and the visor (1) are integrally molded and there are transverse strips (3) between the longitudinal strips (4), which are transversely interlaced with the longitudinal strips (4).

2. The heat dissipating safety helmet according to claim 1, wherein the transverse strips (3) are hollow strips.

3. The heat dissipating safety helmet according to claim 1, wherein the helmet comprises a mounting structure for at least one device selected from goggles, lamp, earplug, mask, breathing device and water shield.

4. The heat dissipating safety helmet according to claim 1, wherein the transverse strips (3) are attached together by fusing, adhesive bonding or supersonic bonding.

5. The heat dissipating safety helmet according to claim 1, wherein the shell is made of plastic or composite material.

6. The heat dissipating safety helmet according to claim 5, wherein the plastic or composite material possess enhanced properties selected from anti-electrostatic property, nonflammable property, heat insulating property, heat reflecting property, heat resistant property, coloured and germicidal property.

* * * * *